United States Patent [19]

Meissner

[11] Patent Number: 4,869,085

[45] Date of Patent: Sep. 26, 1989

[54] CYLINDER LOCK AND KEY

[76] Inventor: Peter E. Meissner, Hohenzollerdamm 89, 1000 Berlin 33, Fed. Rep. of Germany

[21] Appl. No.: 55,724

[22] Filed: May 29, 1987

[30] Foreign Application Priority Data

May 29, 1986 [DE] Fed. Rep. of Germany ..... 3618074

[51] Int. Cl.[4] ..... E05B 19/06

[52] U.S. Cl. ..... 70/409; 70/407; 70/358; 33/540

[58] Field of Search ..... 70/358, 364 A, 378, 70/401, 405–409, 411

[56] References Cited

U.S. PATENT DOCUMENTS

| | | | |
|---|---|---|---|
| 2,105,304 | 1/1938 | Wagner | 70/364 A |
| 2,116,246 | 5/1938 | MacDonald | 70/405 |
| 2,763,027 | 9/1956 | Tampke | 33/540 X |
| 3,022,408 | 2/1962 | Wagner | 70/395 X |
| 3,541,818 | 11/1970 | Dana | 70/406 X |
| 3,668,909 | 6/1972 | Roberts | 70/408 X |
| 4,325,242 | 4/1982 | Tietz | 70/401 |
| 4,400,956 | 8/1983 | Martin | 33/540 X |
| 4,433,487 | 2/1984 | Roland | 70/358 X |
| 4,608,842 | 9/1986 | Tietz | 70/358 |
| 4,712,398 | 12/1987 | Clarkson et al. | 70/276 |
| 4,726,205 | 2/1988 | Allerdist et al. | 70/408 X |

FOREIGN PATENT DOCUMENTS

| | | | |
|---|---|---|---|
| 0029498 | 6/1981 | European Pat. Off. . | |
| 354058 | 6/1922 | Fed. Rep. of Germany | 70/409 |
| 2411362 | 9/1975 | Fed. Rep. of Germany . | |
| 7900875 | 1/1979 | Fed. Rep. of Germany . | |
| 3542008 | 6/1987 | Fed. Rep. of Germany | 70/406 |
| 2492872 | 4/1982 | France | 70/409 |
| 03439 | 10/1983 | World Int. Prop. O. | 70/409 |

*Primary Examiner*—Gary L. Smith
*Assistant Examiner*—Suzanne L. Dino
*Attorney, Agent, or Firm*—Hill, Van Santen, Steadman & Simpson

[57] ABSTRACT

A cylinder lock and key includes one or more lateral ribs extending from a flat key and formed of a shape memory material. Auxiliary lock pins arranged in a cylinder core read the shape of the lateral ribs of the key and enable the lock to be opened only when the memory material of the ribs responds to the application of energy.

10 Claims, 1 Drawing Sheet

CYLINDER LOCK AND KEY

BACKGROUND OF THE INVENTION

1. Field of the Invention

The present invention relates generally to a cylinder lock and a key, the lock having lock pins arranged in a cylinder core to read control faces of the key.

2. Description of the Related Art

German Pat. No. 24 11 362, (DE-PS No. 24 11 362) for example, discloses a cylinder lock and a key having auxiliary longitudinal ribs projecting beyond one or more lateral faces of the flat key. The auxiliary longitudinal ribs cooperate with auxiliary lock pins so that the lock pins sense the ribs. When a seam between the cylinder core and the cylinder housing is in alignment, then the cylinder core can be turned to actuate the lock.

A multi-level lock system and method is disclosed in U.S. Pat. No. 4,325,242, including discontinuous rib members at each side of an elongated key. U.S. Pat. No. 4,608,842 also discloses a lock and key system with auxiliary locking ribs and pins.

In EP-PA No. 00 29 498 is disclosed the sensing of the height of a profile or a sub-profile, the height initially being defined by the inserted key. This occurs due to a radially displaceable ball seated in a bore of the key shank.

It is also known that certain materials including metals and metal alloys have what is referred to as memory or thermal recovery or shape memory. In other words, the metals and alloys displaying such characteristic have a first shape at normal ambient temperatures but assume a modified second shape as a function of the energy received in the form of heat, for example. Thus, such metals and alloys discernibly deviate in shape when heated from their shape when cold. For example, a pilotherm, or temperature switch, operating on this principle is known from German utility model No. 79 00 875.

Memory alloys are known from practice and include, for example, NiTi which is used for pressure, tensile, bending or torsion elements.

SUMMARY OF THE INVENTION

An object of the present invention is to increase the nature and number of keying variation possibilities in a cylinder lock and key.

A further object of the present invention is to provide a cylinder lock and key using shape memory, or heat recoverable, metals or metal alloys to exploit variable shapes developed in response to energy input as a keying variable.

These and other objects of the present invention are achieved in a cylinder lock and key having portions of the key forming pin controlling faces, the portions being of a material with a shape memory. Energy is applied to the control faces to cause the shape memory material to respond so that the control faces assume a height needed for alignment of the lock pins. In preferred embodiments, a plurality of longitudinal ribs or ribs sections of memory material ar provided to form the control faces. A microswitch to initiate the energy application when the key is inserted into the cylinder core is also preferably included.

A particular advantage of the invention is that the key does not show in any way whatsoever the height required of the rib or rib sections to produce alignment of the lock pins with the parting line between the cylinder core and the cylinder housing. This is due to the fact that the height of the rib sections when in the cold condition is not the same as the height required of the rib sections for alignment of the lock pins. Moreover, the required height cannot be identified by an unauthorized user by trial and error, for example, by heating the key in an external source of thermal energy, because the energy application which is required to achieve a defined response of the shape memory material cannot be designationally applied in this way.

The reliability and security of a cylinder lock is considerably enhanced by an apparatus of the present invention. Over and above this, the further possibility is available of at least partially considering a further dimension in the profile shape of the key during manufacture.

DESCRIPTION OF THE PREFERRED EMBODIMENTS

Figure 1:
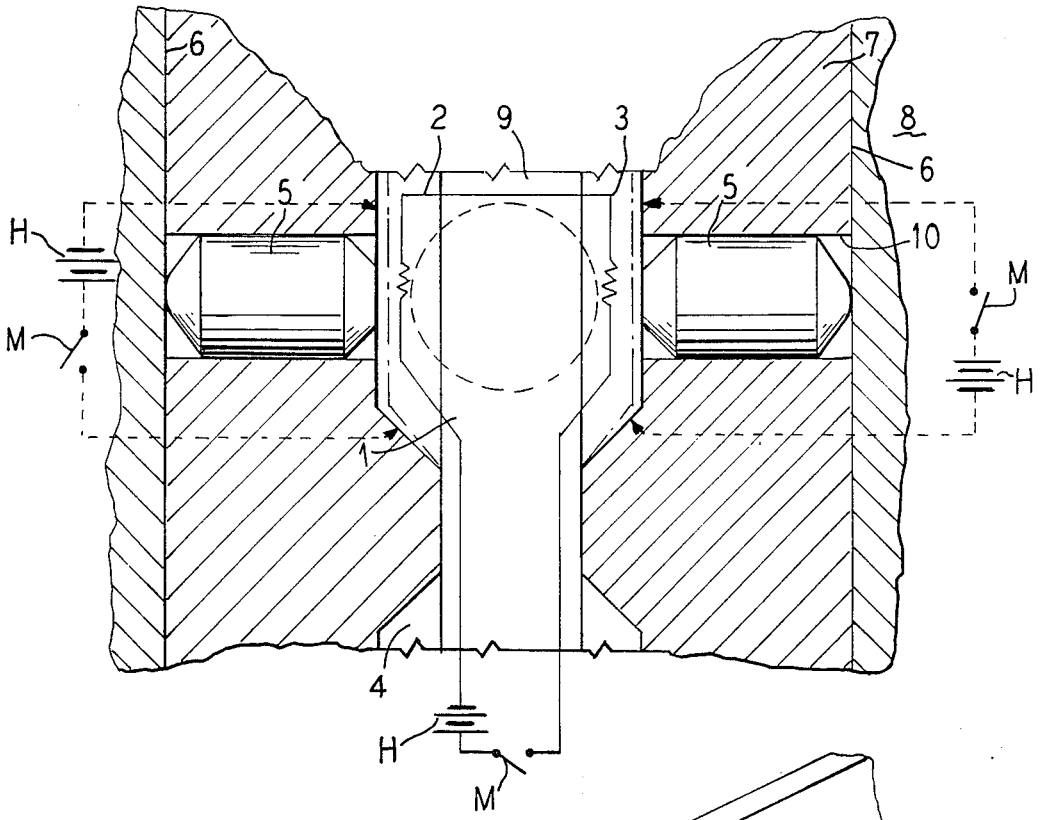
FIG. 1 is an enlarged plan view showing the spine of a flat key with lock pins abutting longitudinal ribs, as well as showing a parting line between a lock cylinder and a cylinder housing.
Figure 2:
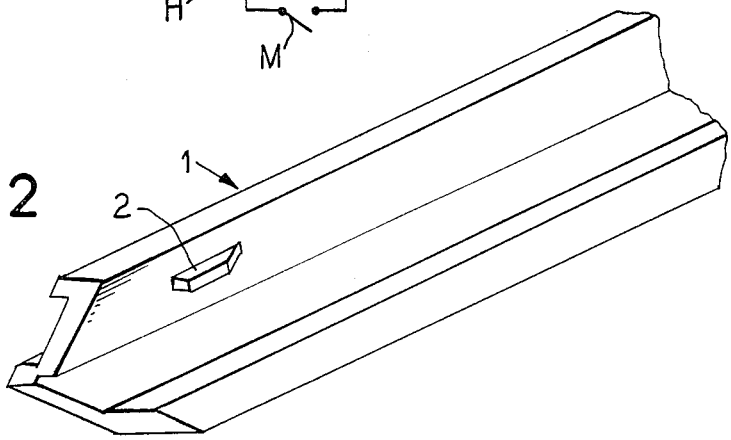
FIG. 2 is a fragmentary perspective view of the key shown in FIG. 1.

In the FIG. 1, a portion of a flat key 1 is shown including a key handle or base 4. A plurality of longitudinal ribs, or rib portions, project from lateral faces of the flat key 1, only rib portions 2 and 3 being shown for simplicity. The height of the rib sections 2 and 3 when in the cold condition is shown in phantom, while the solid outline of the rib sections 2 and 3 indicate the condition assumed by the ribs 2 and 3 when the shape memory or heat recoverable metal or metal alloy of which the ribs are formed responds to the application of energy. It is preferred that the plurality of rib portions have mutually different shape memories. As is shown schematically the energy can be applied either externally, such as from the lock portion, or internally, such as from the key itself. An energy source H is shown schematically either in the key handle 4, or alternately in the lock cylinder housing 8. A microswitch M provides energy to the ribs, and is actuated in a preferred embodiment by insertion of the key into the lock. The energy in the illustrated embodiment is by resistance heating when current is supplied directly to the ribs.

Lock pins 5 are shown, as well as a parting line 6 between a cylinder core 7 and a cylinder housing 8 of the cylinder lock. The lock pins 5 are slidably mounted in channels 10 in the cylinder core 7.

Continued turning of the cylinder core 7 to actuate the lock assumes alignment of the ends the lock pins 5 with the parting line 6, which is only possible when the ribs 2 and 3 have assumed a defined height, the defined height corresponding to the changed shape of the memory material. On the other hand, when the ribs 2 and 3 are in the cold condition, the lock pins 5 slide along the channels 10 in the cylinder core 7 to touch the phantom outlined ribs 2 and 3, and thus after an initial rotation, it would be possible for a tumbler pin, indicated at 9, to drop into a corresponding bore or channel 10 in the cylinder core 7 in which the lock pins 5 ride. Thus, this would prevent further rotation of the lock core 7 so that the lock is not actuated. It would only be possible to further rotate the lock mechanism given a fitting key and assuming the ribs 2 and 3 had assumed the shape as shown by solid outline.

The energy source H for applying energy application to the ribs 2 and 3 is mounted either in the lock portion, or alternately in the key 1 itself. The key handle 4 is a suitable location for mounting the energy source H. It is contemplated that different ribs are connected to receive different amounts of energy necessary to achieve their respective pre-selected lock actuating heights.

It is particulary advantageous to use the present embodiment in combination with electronic locks which already utilize the application of energy to transmission and/or reception units. Modification or retrofitting of such electronic locks by appropriate energy application circuits in accordance with its invention is simple to achieve. For example, the application of energy in one embodiment is initiated only after the reception of an appropriate code by the energy application circuit. Only then does the shape of the rib respond to permit actuation of the lock. Thus, a mechanical code such as by a keypad input is used in conjunction with an electronic code for selective energy application to the ribs 2 and 3, and only when both are supplied is it possible to actuate the lock for opening.

Thus, a high security key is provided for use in a cylinder lock, the key having portions that change shape in response to selective energy application.

Although other modifications and changes may be suggested by those skilled in the art, it is the intention of the inventor to embody within the patent warranted hereon all changes and modifications as reasonably and properly come within the scope of his contribution to the art.

I claim:

1. An improved cylinder lock including a key, auxiliary lock pins being arranged in a cylinder core of said lock cylinder and having first end faces to read control faces of said key, for a fitting key said auxiliary lock pins having second opposite end faces lying in a parting line between said cylinder core and a cylinder housing, the improvement comprising:

portions of said key forming said control faces, said portions being of metal alloy or metal which is shape recoverable in that it assumes a different shape upon the application of energy and reverts to its original shape upon de-energization, said control faces adapted to receive an energy applicaiton to cause said shape recoverable metal alloy or metal to respond so that said control faces assume a height needed for alignment of said second end faces with said parting line to permit rotation of said cylinder core in said cylinder housing; and means for applying energy to said key portions to cause said shape recoverable key portions to respond.

2. A cylinder lock including a key as claimed in claim 1, wherein said key said key is a flat key, and wherein:

said portions forming control faces include at least one longitudinal rib section of said metal alloy or metal having a shape memory and provided projecting from at least one lateral face of said flat key.

3. A cylinder lock including a key as claimed in claim 2, wherein a plurality of said longitudinal rib sections are provided formed of said metal alloy or metal, said plurality of rib sections having mutually different shape memories.

4. A cylinder lock including a key as claimed in claim 1, further comprising:

a microswitch disposed in said cylinder core to initiate the energy application upon insertion of said key.

5. A lock cylinder including a key as claimed in claim 1, further comprising:

an energy source for effecting the energy application, a key handle having said energy source disposed therewithin; and said energy application resulting from contact between said key and said cylinder core when said key is within said cylinder core.

6. A cylinder lock including a key as claimed in claim 1, further comprising:

a transmission and reception unit arranged for energy transmission between said cylinder housing and said key for the energy application.

7. A cylinder lock including a key as claimed in claim 1, further comprising:

an energy source in said cylinder lock for applying energy to said key portions

8. A cylinder lock and key, comprising:

a cylinder housing having slidably mounted lock pins biased for movement toward an axis of said cylinder housing;

a cylinder core having a key receiving opening and being disposed coaxially within said cylinder housing and rotationally movable within said cylinder housing to actuate said cylinder lock upon insertion of as fitting key into said key receiving opening;

at least one auxiliary lock pin slidably mounted in said cylinder core and having first and second opposite end faces;

at least one rib portion extending from said key for contact with said first end face of said at least one auxiliary lock pin upon insertion of said key into said key receiving opening, said at least one rib portion being formed of a shape recoverable material that changes to a different shape upon the application of energy and reverts to its original shape upon de-energization, said at least one rib portion changing shape in response to an application of energy; and means for applying energy to said at least one rib portion to cause said rib portion to change shape and cause said second end face of said auxiliary lock pin to move into alignment with parting line between said cylinder housing and said cylinder core so that said cylinder core can be turned to actuate said lock.

9. A cylinder lock and key as claimed in claim 8, further comprising:

a plurality of auxiliary lock pins in said cylinder core; and a plurality of rib portions of shape recoverable material for contact with corresponding ones of said auxiliary lock pins.

10. In a cylinder lock and key system, the improvement of: a key having presettable key positions made of material that changes shape in response to the selective application of energy and reverts to its original shape upon de-energization, said key portions being arranged and disposed to actuate correspondingly adjacent lock pins, and energy applying means to selectively apply energy to said key positions for actuation of the lock and key system.

* * * * *